United States Patent [19]

Colli et al.

[11] Patent Number: 5,002,234

[45] Date of Patent: Mar. 26, 1991

[54] BOBBIN SUPPORT ARM WITH MODULATION OF MOTION TRANSMISSION BETWEEN A ROLLER AND BOBBIN

[75] Inventors: Luigi Colli; Sergio De Benedet; Luciano Bertoli, all of Pordenone, Italy

[73] Assignee: Savio, S.p.A., Pordenone, Italy

[21] Appl. No.: 361,668

[22] Filed: Jun. 1, 1989

Related U.S. Application Data

[63] Continuation-in-part of Ser. No. 127,190, Dec. 1, 1987, abandoned.

[30] Foreign Application Priority Data

Dec. 1, 1986 [IT] Italy ..... 22520 A/86

[51] Int. Cl.[5] ..... B65H 54/42; B65H 54/38

[52] U.S. Cl. ..... 242/18 DD; 242/18.1

[58] Field of Search ..... 242/18.1, 18 DD, 18 R

[56] References Cited

U.S. PATENT DOCUMENTS

| | | | |
|---|---|---|---|
| 1,915,241 | 6/1933 | Reece | 242/18.1 |
| 2,524,121 | 10/1950 | Crouzet | 242/18 R |
| 3,982,706 | 9/1976 | Delerue | 242/18.1 |

*Primary Examiner*—Stanley N. Gilreath

*Attorney, Agent, or Firm*—Hedman, Gibson, Costigan & Hoare

[57] ABSTRACT

A bobbin support arm with modulation of the motion transmission between a roller and bobbin to prevent ribboning, by means of a rocker movement between the bobbin and roller determined by the oscillation of the arm both in the horizontal plane and in the vertical plane.

7 Claims, 4 Drawing Sheets

Fig.4A
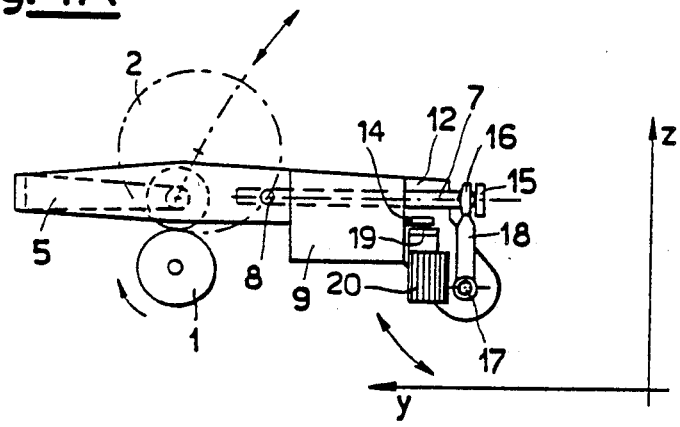
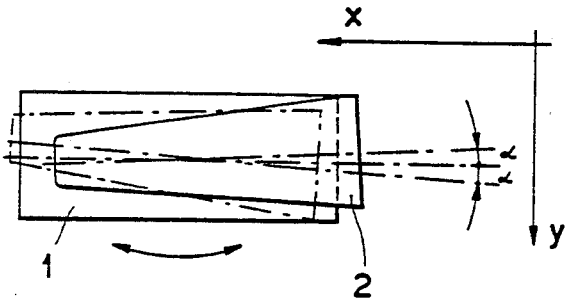
Fig.3A
Fig.3B
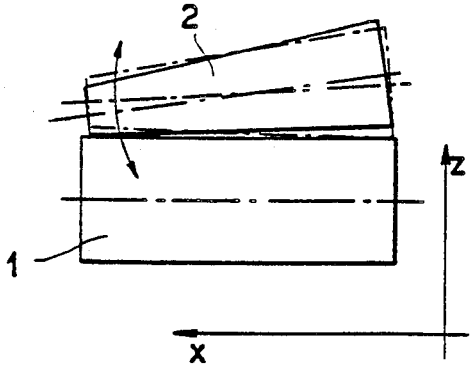

BOBBIN SUPPORT ARM WITH MODULATION OF MOTION TRANSMISSION BETWEEN A ROLLER AND BOBBIN

This is a continuation-in-part of application of Ser. No. 07/127,190, filed Dec. 1, 1987, now abandoned.

This invention relates to a device for modulating the motion transmitted by the bobbin drive roller in a bobbin winding station. The invention is described with reference to a winding machine, but can also find advantageous application in other operations in the textile industry, such as twisting and the like. It relates to bobbin winding both in machine in which the yarn is guided by slots or grooves provided along a spiral path in the bobbin drive roller, and in machine with a separate yarn guide.

The bobbin is commonly driven by a rotary drum—in the form of a right cylinder or cone of small taper—which is kept in contact therewith along a generating line common to the two members. The technical problem to which the present invention relates dervies from the fact that during spooling, the rotary drum remains of constant shape and size, whereas the bobbin which gradually grows because of the yarn wound on it changes continuously in terms of its size and/or shape.

If motion takes place under perfect friction, the peripheral speed of the drive drum coincides subsantially with the linear winding speed of the yarn.

In a very common type of winding machine, the drive drum, usually known as the roller, carries in that surface which engages the bobbin a spiral groove in which the yarn is engaged and guided so as to wind on the bobbin in a spiral pattern. In another type of winding machine, now obsolete because of its poor productivity, the yarn is distributed over the bobbin surface by a yarn guide made to travel with periodic motion along the bobbin generating line.

As the bobbin size increases, its linear yarn winding speed remains substantially constant—and this is a necessary condition for proper execution of this operation—but its angular speed decreases linearly.

As the yarn travels along the contact generating line in a constant time, the number of turns wound for each travel stroke of the yarn guide decreases slightly but continuously with each successive layer.

The number of turns used for forming the complete spiral layer therefore decreases, as the turns become longer.

The phenomenon therefore occurs in which when the spiral generated by the to-and-fro travel of the yarn contains an exact whole number of turns, the next sprial commences exactly superimposed on the preceding.

As analogous drawback—although increasingly less serious—takes place when, instead of a whole number, the generated spiral contains a number of turns $n\frac{1}{2}n\frac{1}{3}n\frac{1}{4}$. . . , where n is a positive whole number, and corresponds to the phenomenon of generating 2,3,4. . . layers of spirals which each commence superimposed on the preceding.

This phenomenon is commonly knwon as ribbing, and means that the bobbin become either unsable or of poor quality. Ribboned bobbins are difficult to unwind in the subsequent operations, are of veriable compactness between their parts so that they cannot be correctly dyed and there is the risk of having to then discard then, and in addition the quantity of wound yarn no longer corresponds to the bobbin size. To prevent ribbon formation it is therefore necessary to avoid an exact ratio—at least for a short time—between the bobbin being wound and the yarn guide device.

The known at uses various expedients of this purpose. The most common expedients are based on discontinuity of roller operation. This can be obtained by periodically raising the bobbin out of contact with the roller. The bobbin continues to rotate while slowing down, until contact with the roller is restored. Alternatively, the roller operation can be interrupted periodically by switching off the supply to its electric drive motor or by disconnecting the roller from the motor.

In more sophisticated versions, the more speed can be periodically varied.

This type of expedient, although widely used, has considerable drawbacks because its effect varies as the size of the bobbin being formed varies.

Its application to right cylindrical bobbins is also problematic because on restoring operation, cosistency of the contact speed must be re-established along the entire generating line.

A different expedient uses axial reciprocal movement between the roller and bobbin, produced by periodically displacing their shafts, for example by the action of a cam.

In this manner, the spiral is made to terminate either before or after the preceding spiral.

This expedient enables the ribbons to be flattened but not eliminated, because excessive travel would deform the bobbin in an unacceptable manner.

A further expedient was based—in the case of the obsolete yarn-guide winding machine—on varying their drive transmission ratio, so varying the travel time (varying the travel time would be equivalent to the preveiously described expedient).

With the obsolescence of yarn-guide winding machines, this expedient is no longer implemented, but even in yarn-guide winding machines these reciprocating motion members presented considerable problems in varying their speed.

A further expedient uses periodic rocking action along the generating line between the roller and bobbin by varying their effective contact diameter. By this means, a variation in the bobbin speed is obtained, enabling the spiral commencement points to be offset.

This expedient offers substantially no drawback when forming conical bobbins, whereas drawbacks are encountered when this action is used in the production of right cylindrical bobbins Varying the effective contact diameter is somewhat difficult, because the mass of yarn already wound and accumulated on the bobbin has to be significantly deformed.

This can become substantially impracticable particularly in the initial stage.

In contrast, the present invention enables the transmission ratio between the roller and bobbin to be regulated by varying the relative position of these latter in a rocking manner not fixed by the generating line, while keeping them always in contact, and thus, without requiring substantial deformation even in the case of right cylindrical bobbins.

For a correct understanding of the interactions between a conical bobbin and a right cylindrical roller which rotate in contact along a generating line, it must be remembered that within the contact segment there exists only one point on the conical bobbin, known as the neutral point, which is driven at the same peripheral speed as that at which the roller rotates. The peripheral speed of a conical bobbin, driven by a cylindrical drive roller, has different values along the length of the bobbin. The peripheral speed of the bobbin increases from the neutral point, at which the peripheral speed is the same as that of the drive roller, toward the end of the bobbin having the major base, so that the part of the bobbin at this side of the neutral point slides on the drive roller with a higher peripheral speed. However, the part of the conical bobbin lying between the neutral point and the end of the bobbin having the samller base has a lower peripheral speed than the drive roller and therefore also slides on the drive roller, but rotates slower than the drive roller.

The aforesaid rocking action in effect moves this neutral point along the contact segment. As the bobbin is deformable, this translation of the contact point takes place gradually along the line of contact.

The device according to the present invention consists of a bobbin support arm and is descirbed hereinafter in terms of a typical embodiment shown on the accompanying figures.

FIGS. 3A and 3B respectively show a top view of the bobbin in different positions with respect to the underlying drive roller, and a front elevation view of the same elements as seen in the direction opposite to the direction y of FIG.1.

FIG. 4 is a view of the invention on the horizontal plane XY and FIG. 4A is a side view of the invention on the plane YZ.

Figure 1:
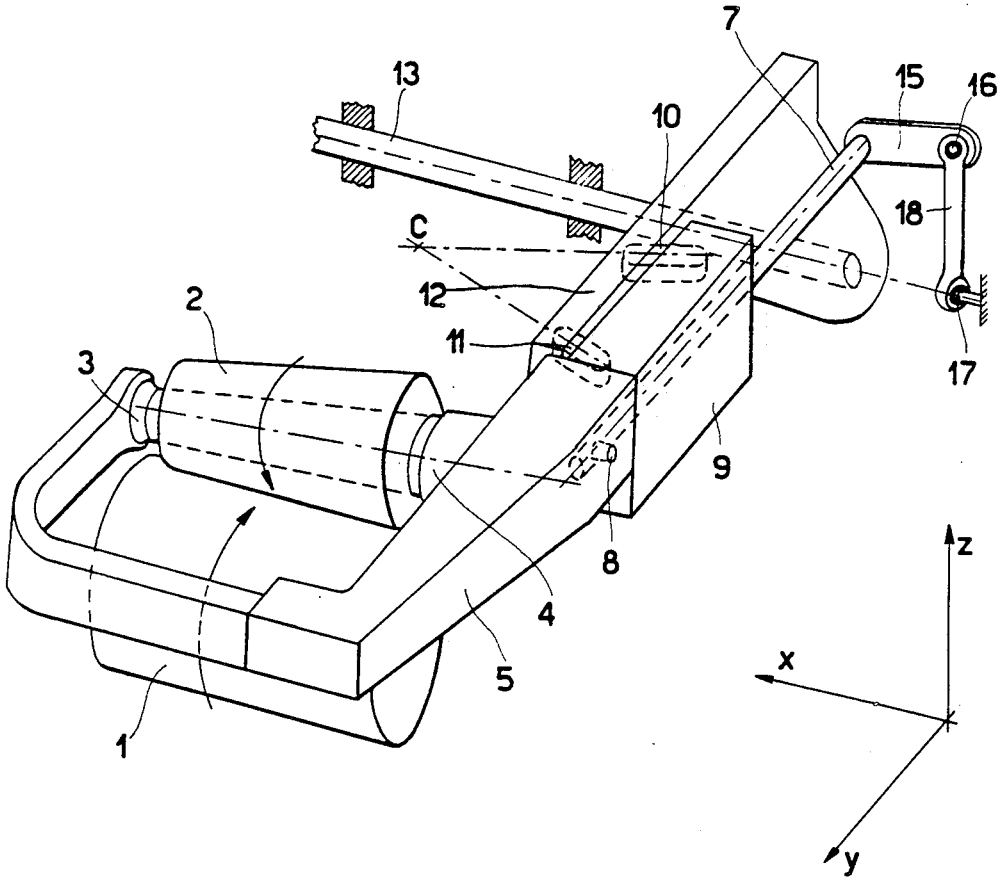
FIG. 1 is a perspective view.
Figure 2:
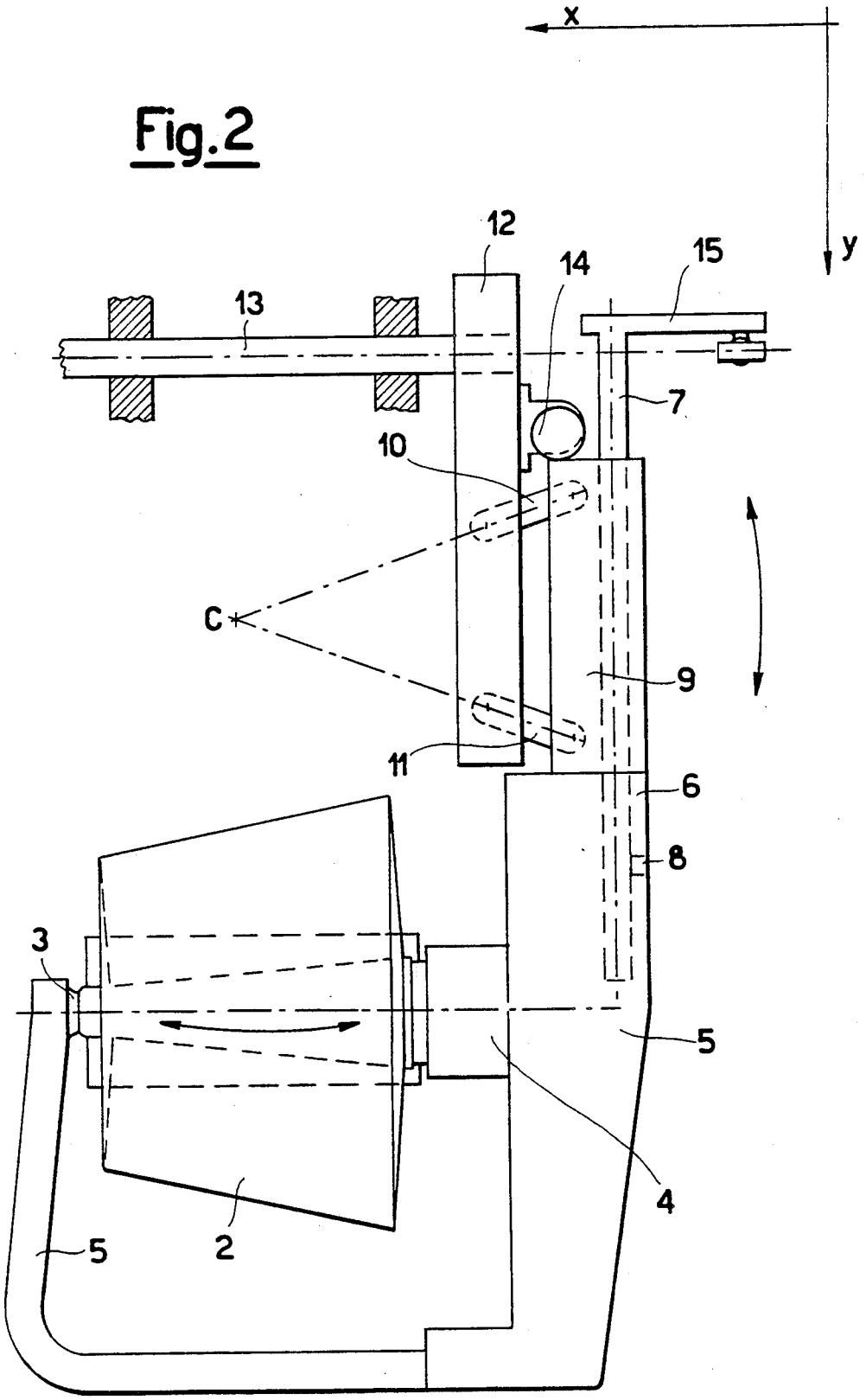
FIG. 2 is a top plane view of the bobbin support arm.
Figure 4:
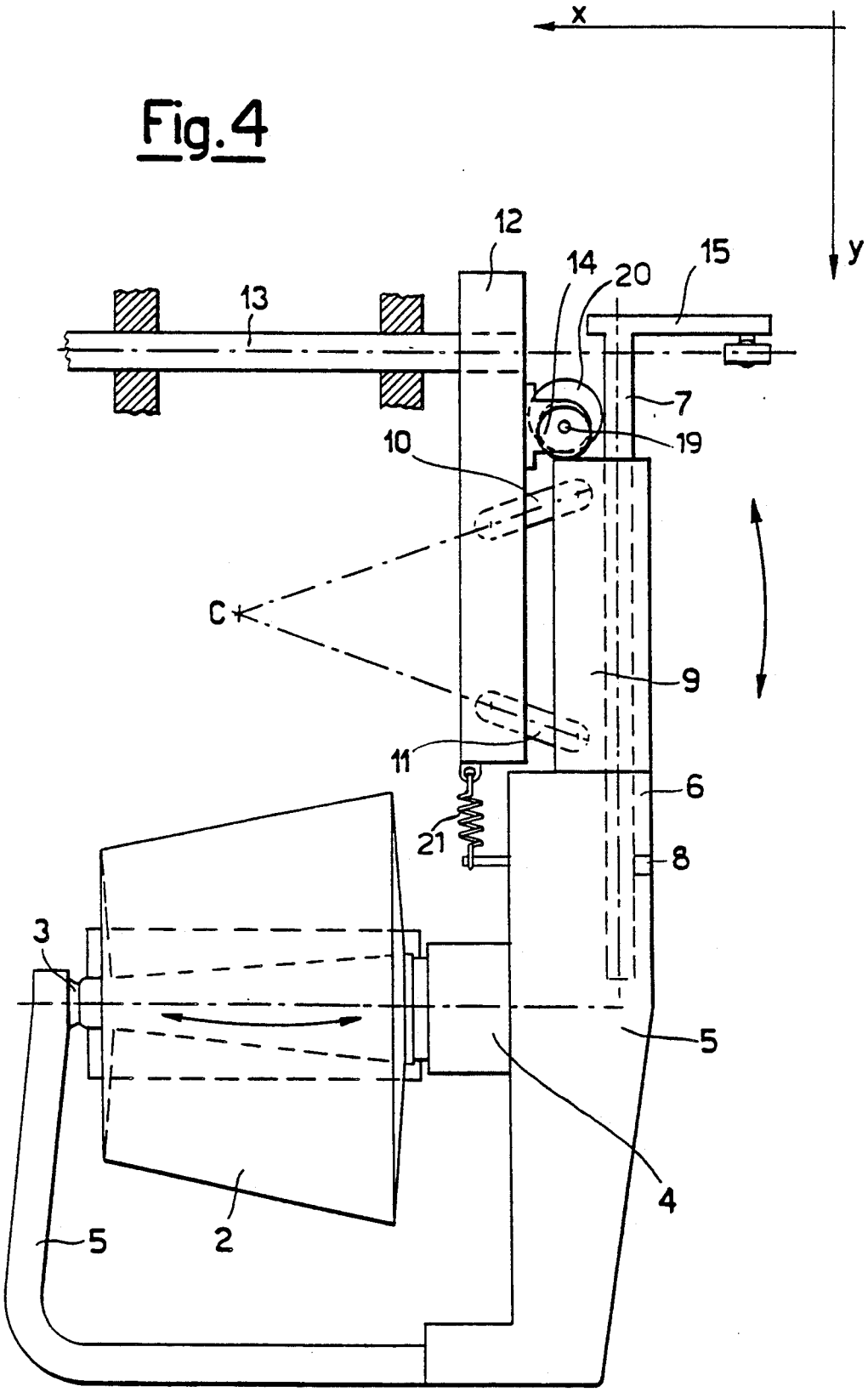

The drive roller, 1, provided with yarn guide grooves, not shown, rotates clockwise to consistently drive the bobbin 2, which rotates in the opposite direction.

The bobbin 2 is supported on a pair of centres 3 and 4 supported by the asymmetric fork 5, which is of a size sufficient to house the finished bobbin. The fork 5 comprises in its end 6 a cylindrical cavity in which a long pin 7 is disposed, and is fixed at 5 by a dowel 8—or an equivalent means—which enables the inclination of the axis of the centres 3 and 4 to the axis of the roller 1 to be adjusted as required, in order to be able to use tubes of different taper.

On the extension of the end 6, and adjacent thereto, there is located a member 9 provided with a precision through bore for the pin 7, which extends beyond that face thereof distant from the end 6.

The member 9 is connected by two non-parallel connecting rods 10 and 11 to the support 12, these four elements forming an articulated quadrilateral. The articulated quadrilateral enable the member 9 to move with semi-circular motion about the centre C which is defined by the point at which the axes off the connecting rods 10 and 11 intersect. The support 12 can rotate only in a vertical plane about pivot 13.

The rotation of the support 12 is determined by the increase in the diameter of the bobbin or by external action to raise the fork 5. Rotating the support 12 results in the inclination of the rotation plane of the support 9.

Rigid with the member 12 there is a device 14 for driving the member 9 with reciprocating motion, and indicated by way of example as a rotating cam with a cam rotation pin 19 that is positioned eccentric with respect to the contour of the cam. However, device 14 also can be in the from of a connecting rod and crank or other linkages known to the art, to cause the member 9 to oscllate about the centre C and induce an oscillatory movement in the bobbin 2 by way of the pin 7, the fork 5 and the centres 3 and 4. and 4A cam 14 is rotated by pin 19 which is rotated by a gearmotor 20 providing a slow rotational speed of the cam 14 related to the winding speed. For maintaining member 9 in contact with cam 14 the weight of member 5 and bobbin 2, which is being wound, may suffice, because it provides a force having a component in the direction of bar 7. In fact, the level of the gravity center of the elements 2,5,6, and 9 lies higher than the level of cam 14 and pivot axis 13 and this is the reason why a force having component directed in the direction of bar 7 may be provided. The greater the bobbin under formation, the greater the force with which member 9 is urged against cam 14.

In any case, to assist in maintaining constant contact between member 9 and cam 14, a biasing means in the form of a spring 21 can be arranged between member 5 and support 12. Such a spring does not hinder movement of the bobbin holder fork 5 to provide orientation of the bobbin as shown in FIGS. 3A and 3B.

Member 9 is movable lengthwise in the drection of bar 7 in unsion with member 5, because it is constantly pressed between the latter and cam 14. However, member 9 is independent from member 5 as to rotational movement relative to member 5 about axis of bar 7, since bar 7 enters a precision bore of member 9 but is not fastened thereto. The bar 7 is instead fastened to member 5 at 8.

During operation, members 9 and 5 move in unsion as far as pivotal movement about center C is concerned, but slightly rotate relative to each other about an axis coincident with the axis of bar 7, because member 5, which is fixed to bar 7, performs slight rotational movement therewith, while member 9 cannot rotate about said axis owing to its connection to rods 10 and 11. Slight rotation of bar 7 about it own axis to perform movement shown in FIG. 3B is due to means 15–18. The pin 7 terminetes in a transeverse bar 15 connected to a fixed part by two ball joints 16 and 17 which are connected together by an intermediate bar 18. The centre of rotation of the second joint 17 lies preferably on the aixs of the pivot 13 or in proximity to it.

With reference to FIG. 3A, the operation of the device 14 causes the member 9 to oscilate, and this oscillation influences the contact of the bobbin 2—which for ease of representation is shown in its initial stage—with the roller 1.

The bobbin 2 moves continuously from the position shown by full lines, which corresponds to the member 9 in its position of maximum withdrawal, to the position shown by dashed lines, which corresponds to the member 9 in its opposite position of maximum advancement.

As a result of the osillation of the member 9, which causes consistent oscillation of the axis of the pin 7, the restraint formed by the ball joints 16 and 17 causes the pin 7 to rotate about its axis. This rotation generates in the frok 5 and bobbin 2 the rocking movement in the vetical plane shown in FIG. 3B.

The movements of the bobbin 2 relative to the drive roller 1 as shown by dotted lines in FIGS. 3A and 3B, i.e., rocking about a substantially vertical axis and rocking about a substantially horizontal axis in combination with axial displacement of the bobbin, cause the neutral point to travel along a path which does not extend along the (straight) generated line of the conical and respectively cylindrical surfaces of the bobbin and drive roller in the neutral position thereof, in which the axes of the two elements lin in the same plane that also contains the With regard to the behaviour of cylindrical bobbins, is should be noted that the motion shown in FIG. 3A sonsists both of axial translation and of rotation of the bobbin axis about the roller axis, these consequently no longer lying in the same plane. As a consequence of said rotation, the speed—both peripheral and angular—of the bobbin 2 is reduced by the cosine of $\alpha$, where $\alpha$ is the angular value of the rotation.

Even for small values of $\alpha$, this speed variation is sufficient to prevent bobbin ribboning 60.

We claim:

1. A bobbin support device including a drive roller wherein the device inhibits the formation of ribboning during the winding of bobbins, comprising:

(a) a bobbin holding means having a pair of centers on respective arms for supporting the ends of the bobbin wherein one arm has a bore;

(b) an element having a bore axially aligned with said holding means bore;

(c) a rotatable pin extending through said bore of said element and fixedly attached in said holding means bore;

(d) a pair of non-parallel connecting rods operatively connected to said element;

(e) an articulated pivot means including a transverse bar and an intermediate bar wherein said transverse bar is fixedly attached at one end to said pin and at its other end to one end of said intermediate bar by a first ball joint, and wherein said intermediate bar is connected at its other end to a fixed member by a second ball joint;

(f) a support bar with a bore connected to said element by said pair of non-parallel rods thereby forming a trapezoidal arrangement with said pair of non-parallel rods and said element, wherein said support bar is adapted for rotating in a vertical plane above the axis of the roller;

(g) a pivot inserted in said support bar bore around which said support bar rotates; and (h) a drive means attached to said support bar for oscillating said element and said bobbin holding means in a semi-circular movement by the articulation of said pair of non-parallel rods so that the axis of the bobbin is axially translated along the axis of the roller and for rotating said pin and pivoting said bobbin holding means in a semi-circular movement by the articulation of said articulated pivot means so that the axis of the bobbin is pivoted above the axis of the roller.

2. The device of claim 1, wherein said second ball joint lies on or in close proximity to the axis of rotation of said support bar.

3. The device of claims 1 or 2, wherein said drive means includes a rotating cam.

4. The device of claim 1, or 2, wherein said drive means comprises a connecting rod and crank.

5. The device of claim 1, wherein the position of said pin and the position of said bobbin holding means is regulated as a function of the taper of said wound bobbin.

6. The device of claim 1 or 2 further comprising a biasing means connecting said holding means to said support bar.

7. the device of claim 6 wherein said biasing means comprises a spring.

* * * * *